US011804156B2

(12) United States Patent
Fujikawa

(10) Patent No.: US 11,804,156 B2
(45) Date of Patent: Oct. 31, 2023

(54) ELECTRO-OPTICAL DEVICE AND ELECTRONIC APPARATUS

(71) Applicant: SEIKO EPSON CORPORATION, Tokyo (JP)

(72) Inventor: Shinsuke Fujikawa, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/938,945

(22) Filed: Sep. 7, 2022

(65) Prior Publication Data

US 2023/0074276 A1 Mar. 9, 2023

(30) Foreign Application Priority Data

Sep. 9, 2021 (JP) ..... 2021-146818

(51) Int. Cl.
*G09G 3/00* (2006.01)
*G09G 3/36* (2006.01)

(52) U.S. Cl.
CPC ..... *G09G 3/006* (2013.01); *G09G 3/3666* (2013.01); *G09G 2320/041* (2013.01); *G09G 2330/12* (2013.01)

(58) Field of Classification Search
CPC ..... G09G 3/006; G09G 3/3666; G09G 2320/041; G09G 2330/12; G09G 3/002
USPC ..... 324/537, 515, 500
See application file for complete search history.

(56) References Cited

U.S. PATENT DOCUMENTS

2021/0104186 A1 4/2021 Fujikawa
2022/0293021 A1* 9/2022 Hong ..... G09G 3/3225
2022/0293022 A1* 9/2022 Masuda ..... G09G 3/3233
2023/0120028 A1* 4/2023 Ahn ..... G09G 3/006 345/204

FOREIGN PATENT DOCUMENTS

JP 2004-117260 4/2004
JP 2006-349466 12/2006
JP 2010-073810 4/2010
JP 2021-056175 4/2021

* cited by examiner

*Primary Examiner* — Giovanni Astacio-Oquendo
(74) *Attorney, Agent, or Firm* — JCIPRNET

(57) ABSTRACT

A first substrate of an electro-optical device is provided with a temperature detection circuit including a temperature detection element, and a first wiring line and a second wiring line of the temperature detection element are electrically connected to a first terminal and a second terminal, respectively. Between the first terminal and the second terminal, a third terminal that is not electrically connected to the temperature detection element is provided. Thus, through detection of a current at the time of applying a ground potential from a first probe and a second probe of an inspection device to the first terminal and the second terminal and applying a predetermined voltage from a third probe to the third terminal, insulation between the first terminal and the second terminal can be inspected.

12 Claims, 10 Drawing Sheets

ELECTRO-OPTICAL DEVICE AND ELECTRONIC APPARATUS

The present application is based on, and claims priority from JP Application Serial Number 2021-146818, filed Sep. 9, 2021, the disclosure of which is hereby incorporated by reference herein in its entirety.

BACKGROUND

1. Technical Field

The present disclosure relates to an electro-optical device including a temperature detection element and to an electronic apparatus.

2. Related Art

A technique is conceivable in which an electro-optical device such as a liquid crystal device is provided with a temperature detection circuit including a temperature detection element on an outer side of a display region and a drive condition of the electro-optical device is corrected or the like based on a detection result acquired by the temperature detection element (see JP-A-2021-56175). The electro-optical device described in JP-A-2021-56175 is provided with an electrostatic protection circuit including a transistor electrically connected to the temperature detection element in parallel. Further, an anode terminal electrically connected to an anode wiring line of the temperature detection element and a cathode terminal electrically connected to a cathode wiring line of the temperature detection element are arranged at positions adjacent to each other.

For detection of a temperature in the temperature detection circuit disclosed in JP-A-2021-56175, a voltage between the anode terminal and the cathode terminal at the time of supplying a constant current to the temperature detection element formed of diodes, is detected. Therefore, in order to supply a predetermined constant current to the temperature detection element, it is required to secure sufficient insulation between the anode terminal and the cathode terminal. In order to secure sufficient insulation, it is required to inspect insulation by supplying electric power to the anode terminal and the cathode terminal. However, when a forward voltage is applied between the anode terminal and the cathode terminal during the inspection, a current flowing through the temperature detection element is detected because the temperature detection element is electrically connected between the anode terminal and the cathode terminal. Further, in a case in which the transistor is electrically connected between the anode terminal and the cathode terminal, when a reverse voltage is applied between the anode terminal and the cathode terminal, a current flowing through the transistor in a diode-connected state is detected. In addition, when the anode terminal and the cathode terminal are formed of light-transmissive conductive films, it is difficult to optically inspect whether a short-circuit section, which is caused by residues of the light-transmissive conductive films or the like, is present between the anode terminal and the cathode terminal. Thus, it is not easy to perform insulation inspection between the terminals electrically connected to the temperature detection element, which causes a problem.

SUMMARY

In order to solve the above-mentioned problem, an electro-optical device according to one aspect of the present disclosure includes a temperature detection circuit including a temperature detection element, a first terminal electrically connected to the temperature detection element, a second terminal electrically connected to the temperature detection element, and a third terminal that is not electrically connected to the temperature detection element, between the first terminal and the second terminal.

The electro-optical device according to the present disclosure is used for an electronic apparatus.

DESCRIPTION OF EXEMPLARY EMBODIMENTS

Figure 1:
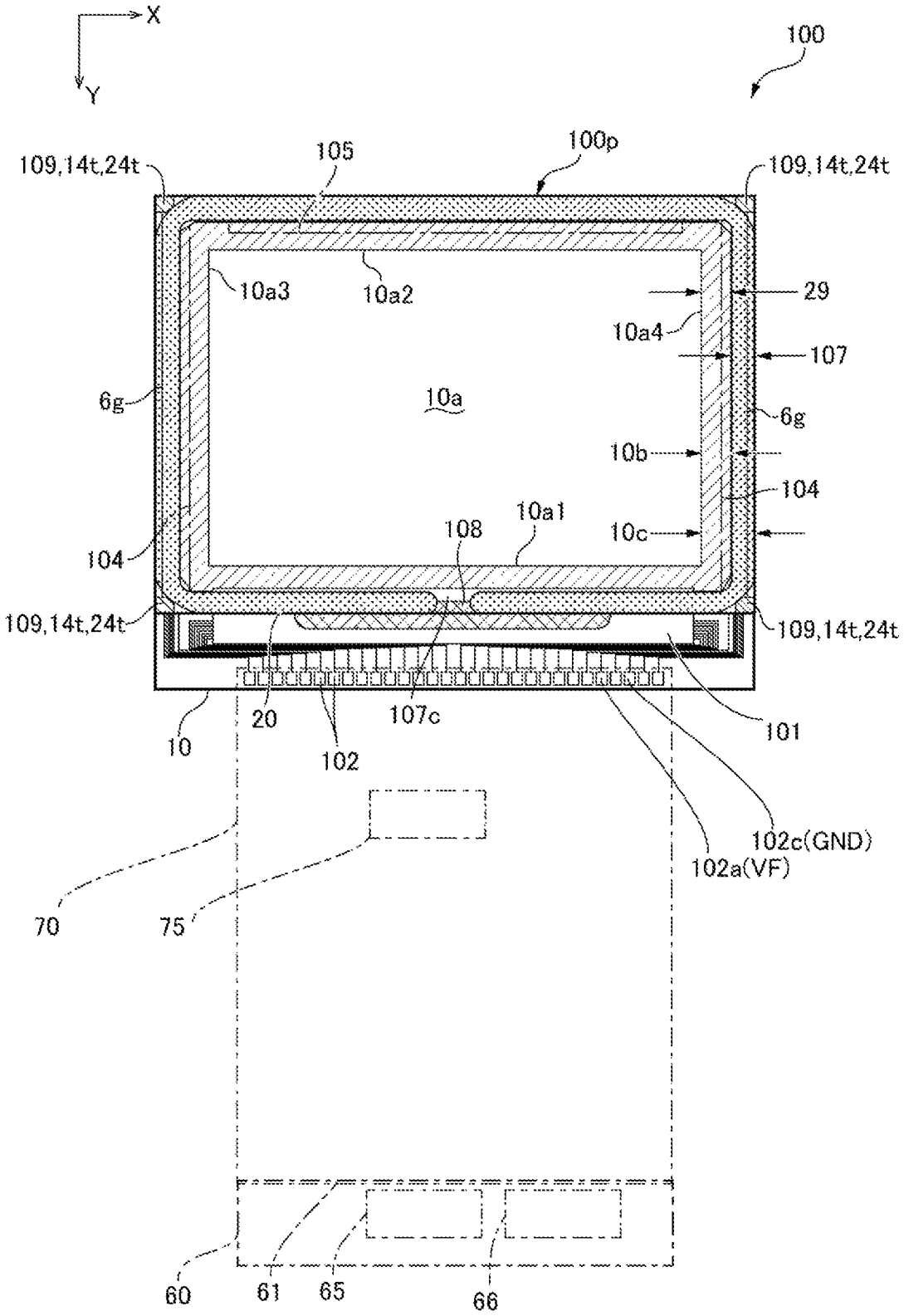
FIG. 1 is a plan view illustrating a configuration example of an electro-optical device according to a first exemplary embodiment of the present disclosure.

Exemplary embodiments of the present disclosure are now described herein with reference to the accompanying drawings. Note that, in each of the figures to be referred to in the following description, to illustrate each layer, each member, and the like in a recognizable size in the drawings, each layer, each member, and the like are illustrated at a different scale.

1. FIRST EXEMPLARY EMBODIMENT

1-1. Specific Configuration of Electro-optical Device 100

Figure 2:
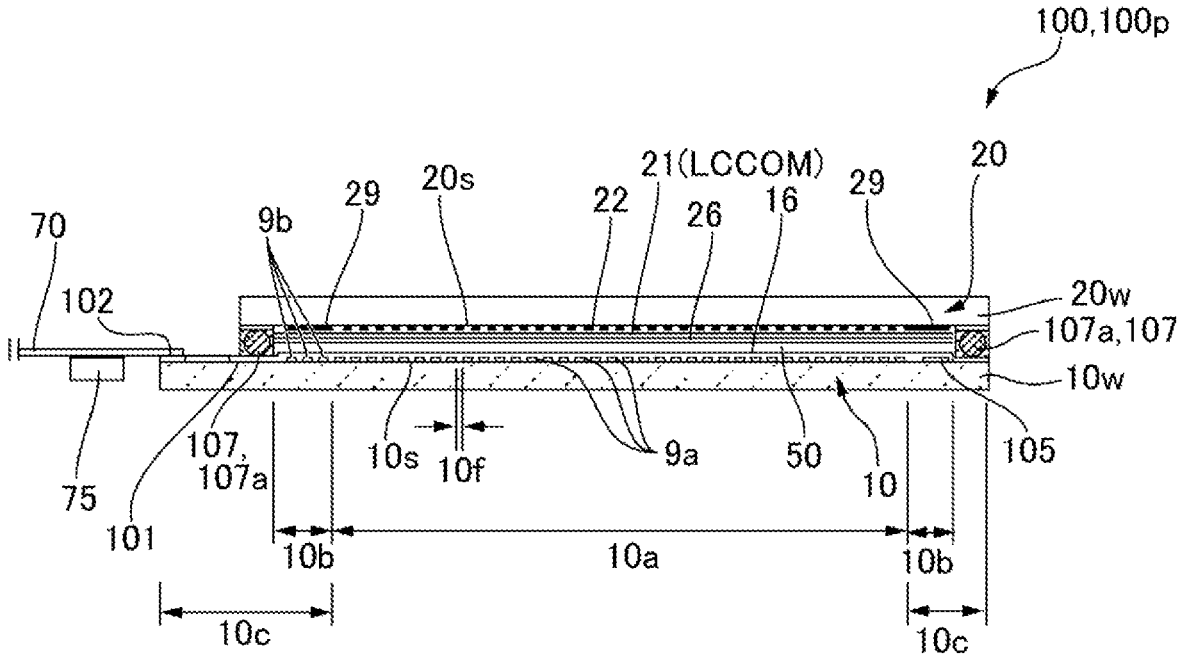
FIG. 2 is an explanatory diagram schematically illustrating a cross-section of the electro-optical device illustrated in FIG. 1.

FIG. 1 is a plan view illustrating a configuration example of an electro-optical device 100 according to a first exemplary embodiment of the present disclosure. FIG. 2 is an explanatory diagram schematically illustrating a cross-section of the electro-optical device 100 illustrated in FIG. 1. The electro-optical device 100 illustrated in FIG. 1 and FIG. 2 is a liquid crystal device, and the electro-optical device 100 includes an electro-optical panel 100*p* including a liquid crystal panel. In the electro-optical device 100, a first substrate 10 and a second substrate 20 are bonded together by a seal material 107 via a predetermined gap between the first substrate 10 and the second substrate 20, and the seal material 107 is provided in a frame shape along an outer periphery of the second substrate 20. The seal material 107 is an adhesive including a photocurable resin, a thermosetting resin and the like, and the seal material 107 includes a gap material 107*a* such as glass fiber or glass beads compounded to set a distance between the first substrate 10 and the second substrate 20 to a predetermined value. In the electro-optical device 100, an electro-optical layer 50 including a liquid crystal layer is provided inside a region surrounded by the seal material 107, of a space between the first substrate 10 and the second substrate 20. In the seal material 107, a cut portion 107*c* used as a liquid crystal injection port is formed, and such a cut portion 107*c* is sealed by a sealing material 108 after a liquid crystal material is injected. Note that in a case in which the liquid crystal material is injected and sealed by using a dropping method, the cut portion 107*c* is not formed. Each of the first substrate 10 and the second substrate 20 has a quadrangular shape. In a substantially central portion of the electro-optical device 100, a display region 10*a* is provided as a quadrangular region. In accordance with such a shape, the seal material 107 is also provided in a substantially quadrangular shape, and an outer peripheral region 10*c* having a quadrangular frame shape is provided on the outer side of the display region 10*a*.

It is assumed that the display region 10*a* has two sides extending in an X direction, which are a first side 10*a*1 and a second side 10*a*2, and two sides extending in a Y direction, which are a third side 10*a*3 and a fourth side 10*a*4. In this case, in the outer peripheral region 10*c* of the first substrate 10, a data line drive circuit 101 is provided between the end of the first substrate 10 and the first side 10*a*1 of the display region 10*a*, and a detection circuit 105 is provided between the end of the first substrate 10 and the second side 10*a*2 of the display region 10*a*. Scanning line drive circuits 104 are provided between the end of the first substrate 10 and the third side 10*a*3 of the display region 10*a* and between the end of the first substrate 10 and the fourth side 10*a*4 of the display region 10*a*.

When the electro-optical device 100 is mounted to an electronic apparatus, an upper circuit 60 is electrically connected to the first substrate 10 via a wiring substrate 70. Thus, terminals 102 for mounting are arrayed at the end on the side close to the data line drive circuit 101, of the ends of the first substrate 10. A wiring substrate 70 is electrically connected to the terminals 102. The wiring substrate 70 is electrically connected to the upper circuit 60 via a connector 61. The wiring substrate 70 is provided with a drive circuit element 75 that includes a drive IC or the like for supplying image data or the like to the electro-optical panel 100*p*. The upper circuit 60 is provided with the image control circuit 65 that outputs image data to the drive circuit element 75. Further, the plurality of terminals 102 includes a first terminal 102*a* and a second terminal 102*c* that are electrically connected to a first wiring line La and a second wiring line Lc of a temperature detection circuit 1, respectively, which is described later, in addition to the terminal 102*g*. The upper circuit 60 is provided with a temperature detection drive circuit 66 that drives a temperature detection circuit 1. Note that the wiring substrate 70 may be configured by electrically coupling a plurality of substrates to each other in some cases. The upper circuit 60 is provided to a host device with respect to the electro-optical device 100 in the electronic apparatus described later.

The first substrate 10 includes a light-transmissive substrate main body 10*w*, such as a quartz substrate or a glass substrate. On a side of a first surface 10*s* of the first substrate 10, which faces the second substrate 20, a plurality of pixel transistors and pixel electrodes 9*a* are formed in a matrix pattern in the display region 10*a*. The pixel electrodes 9*a* are electrically connected to the plurality of pixel transistors, respectively. A first oriented film 16 is formed on the upper layer side of the pixel electrodes 9*a*. On the side of the first surface 10*s* of the first substrate 10, dummy pixel electrodes 9*b* are formed at a part extending along each side of the display region 10*a*, the part being present in a quadrangular frame-shaped region 10*b* extending between the display region 10*a* and the seal material 107. The dummy pixel electrodes 9*b* are simultaneously formed with the pixel electrodes 9*a*.

The second substrate 20 includes a light-transmissive substrate main body 20*w*, such as a quartz substrate or a glass substrate. On a side of a first surface 20*s* of the second substrate 20, a common electrode 21 is formed. The common electrode 21 is formed substantially entirely at the first surface 20*s* of the second substrate 20. On the side of the first surface 20*s* of the second substrate 20, in the frame-shaped region 10*b*, a light shielding partition 29 is formed on the bottom layer side of the common electrode 21, and a second oriented film 26 is laminated on a surface of the common electrode 21. The display region 10*a* is defined by an inner periphery of the partition 29. A light-transmissive planar film 22 is formed between the partition 29 and the common electrode 21. The light shielding layer forming the partition 29 may be formed as a black matrix portion overlapping with an inter-pixel region 10*f* sandwiched between adjacent pixel electrodes 9*a*. The partition 29 is formed at a position of overlapping with the dummy pixel electrodes 9*b* in a planar manner. The partition 29 is formed by a light-shielding metal film or a black resin.

For example, the first oriented film 16 and the second oriented film 26 are each an inorganic alignment film including a diagonally vapor-deposited film of $SiO_x(x \leq 2)$, $TiO_2$, MgO, $Al_2O_3$ and the like, and each includes a columnar structure layer, in which columnar bodies, referred to as columns, is formed obliquely with respect to the first substrate 10 and the second substrate 20. Thus, the first oriented film 16 and the second oriented film 26 cause nematic liquid crystal molecules, which have negative dielectric anisotropy used in the electro-optical layer 50, to be oriented in an obliquely inclined manner with respect to the first substrate 10 and the second substrate 20, thereby causing the liquid crystal molecules to be pre-tilted. In this way, the electro-optical device 100 is configured as a liquid crystal device of a normally black Vertical Alignment (VA) mode.

On the outer side of the seal material 107 at the first substrate 10, inter-substrate conduction electrode portions 14*t* are formed at positions of overlapping with four corner portions 24*t* of the second substrate 20. The inter-substrate conduction electrode portions 14*t* are conductively connected to wiring lines 6*g*, and the wiring lines 6*g* are conductively connected to a terminal 102 of the terminals 102, which is for supplying a common potential LCCOM. Inter-substrate conduction materials 109 including conductive particles are arranged between the inter-substrate conduction electrode portions 14*t* and the corner portions 24*t*, and the common electrode 21 of the second substrate 20 is electrically connected to the side of the first substrate 10 via the inter-substrate conduction electrode portions 14*t* and the inter-substrate conduction materials 109. Thus, the common potential LCCOM is applied to the common electrode 21 from the side of the first substrate 10.

The electro-optical device 100 according to the present exemplary embodiment is a transmission-type liquid crystal device. Thus, the pixel electrodes 9*a* and the common electrode 21 are each formed of a light-transmissive conductive film, such as an Indium Tin Oxide (ITO) film and an Indium Zinc Oxide (IZO) film. In such a transmission-type liquid crystal device, for example, light source light entering from the side of the second substrate 20 is modulated before being emitted from the first substrate 10, thereby displaying an image. Note that the electro-optical device 100 may be a reflection-type liquid crystal device when the pixel electrodes 9*a* are formed of reflective metal such as aluminum.

1-2. Electrical Configuration of Electro-Optical Device 100

Figure 3:
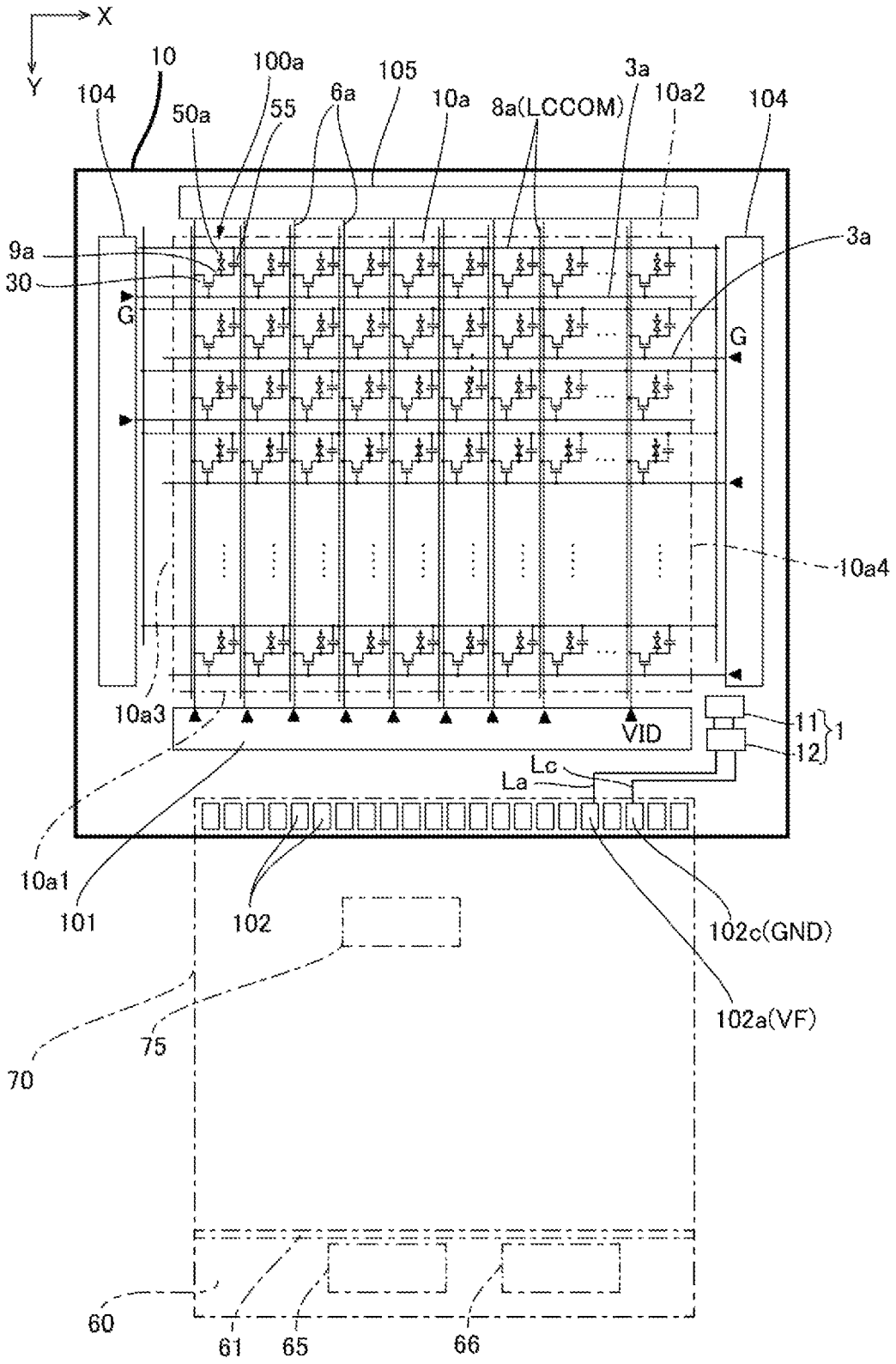
FIG. 3 is a circuit block diagram illustrating an electrical configuration of a first substrate illustrated in FIG. 2.

FIG. 3 is a circuit block diagram illustrating an electrical configuration of the first substrate 10 illustrated in FIG. 2. In FIG. 3, the first substrate 10 includes the display region 10*a*. In the substantially center region of the display region 10*a*, a plurality of pixels 100*a* are arrayed in a matrix pattern. A plurality of scanning lines 3*a* extending from the scanning line drive circuit 104 in the X direction and a plurality of data lines 6*a* extending from the data line drive circuit 101 in the Y direction are provided on the inner side of the display region 10*a* of the first substrate 10. The pixels 100*a* are formed in correspondence with intersections between the scanning lines 3*a* and the data lines 6*a*. The plurality of data lines 6*a* are electrically connected to the detection circuit 105 on the second side 10*a*2 side of the display region 10*a* in the Y direction. A pixel transistor 30 formed of a field effect transistor and the pixel electrode 9*a* that is electrically connected to the pixel transistor 30 are formed in each of the plurality of pixels 100*a*. In the present exemplary embodiment, the pixel transistor 30 is formed of an N-channel type thin film transistor having an LDD structure. The data line 6*a* is electrically connected to a source of the pixel transistor 30, the scanning line 3*a* is electrically connected to a gate of the pixel transistor 30, and the pixel electrode 9*a* is electrically connected to a drain of the pixel transistor 30. The data line drive circuit 101 supplies an image signal VID to the data line 6*a*, and the scanning line drive circuit 104 supplies a scanning signal G to the scanning line 3*a*. The detection circuit 105 is a transistor array. One source-drain of the transistor is electrically connected to the data line 6*a*, the other source-drain thereof is electrically connected to an inspection line (not illustrated), and a gate thereof is electrically connected to a control signal line (not illustrated) in the detection circuit 105.

In each of the pixels 100*a*, the pixel electrode 9*a* faces the common electrode 21 of the second substrate 20, which is described above with reference to FIG. 2, via the electro-optical layer 50, and forms a liquid crystal capacitor 50*a*. A retention capacitor 55 arranged in parallel with the liquid crystal capacitor 50*a* is added to each pixel 100*a* so as to prevent fluctuations of the image signal VID held by the liquid crystal capacitor 50*a*. In the present exemplary embodiment, common potential wiring lines 8*a* extending across the plurality of pixels 100*a* are formed as capacitance lines in the first substrate 10 so as to form the retention capacitor 55, and common potential LCCOM is supplied to the common potential wiring line 8*a*. Each common potential wiring line 8*a* is provided so as to overlap with at least one of the scanning line 3*a* and the data line 6*a* in plan view. As an example, FIG. 3 illustrates a mode in which the common potential wiring line 8*a* overlaps with both the scanning line 3*a* and the data line 6*a* in plan view. The common potential wiring line 8*a* may be configured so as to overlap with, of the scanning line 3*a* and the data line 6*a*, the data line 6*a* in plan view. FIG. 3 illustrates a configuration in which the scanning line drive circuit 104 arranged on the left side of the display region 10*a* drives the scanning lines 3*a* in the odd-numbered rows and the scanning line drive circuit 104 arranged on the right side of the display region 10*a* drives the scanning lines 3*a* in the even-numbered rows, however, there may be adopted a configuration in which the scanning line drive circuits 104 arranged on both the right and left sides drive the same scanning lines 3*a*.

1-3. Configurations of Temperature Detection Circuit 1 and the Like

Figure 4:
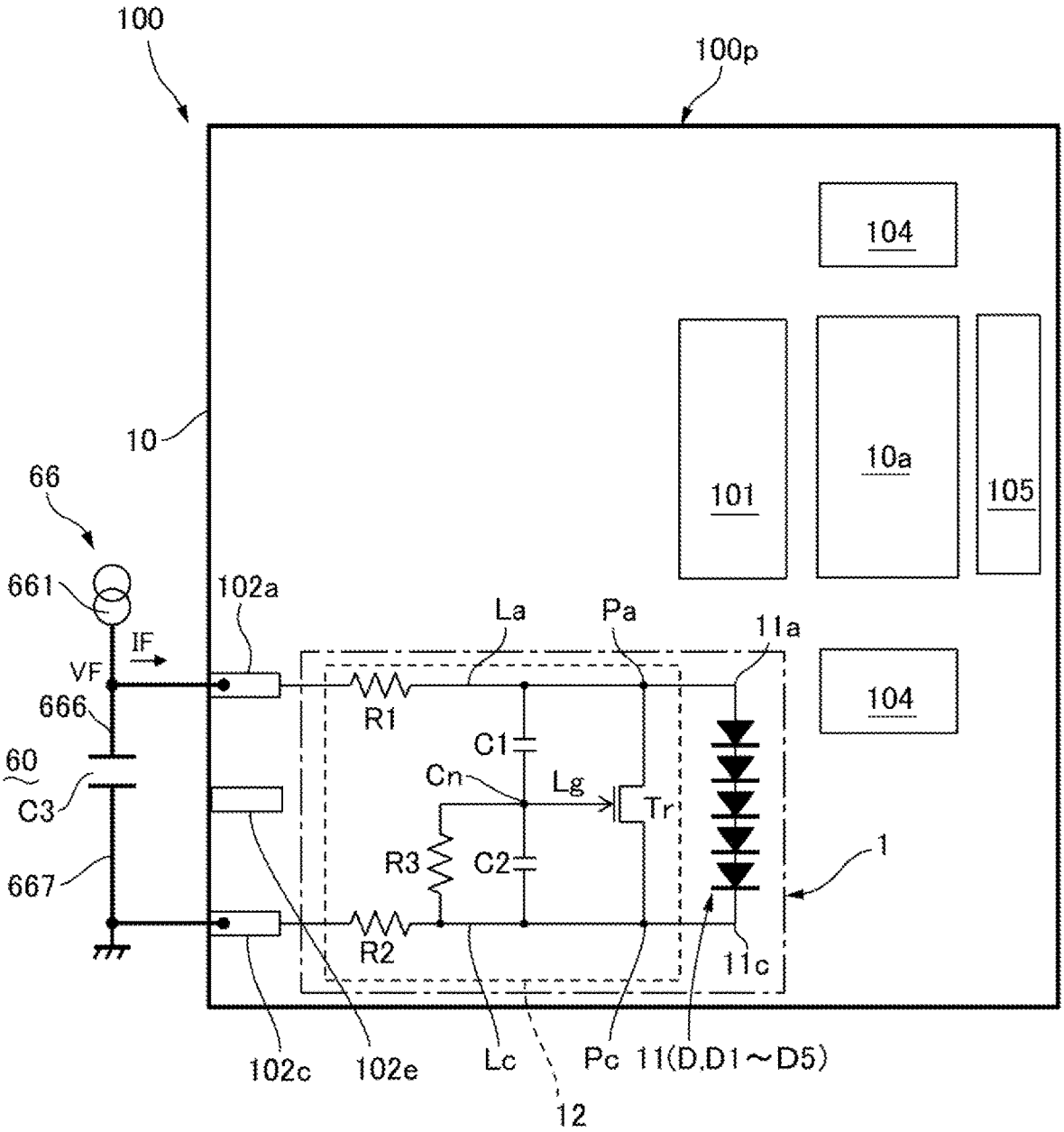
FIG. 4 is an explanatory diagram of a temperature detection circuit and the like illustrated in FIG. 3.

FIG. 4 is an explanatory diagram of the temperature detection circuit 1 and the like illustrated in FIG. 3. As illustrated in FIG. 4 in a schematic manner, the temperature detection circuit 1 that detects a temperature of the electro-optical panel 100*p* is provided on the outer side of the display region 10*a* of the first substrate 10. The temperature detection circuit 1 includes a temperature detection element 11 for detecting a temperature and an electro-static protection circuit 12. The electro-static protection circuit 12 includes a transistor Tr electrically connected to the temperature detection element 11 in parallel.

For example, the temperature detection element 11 includes a plurality of diodes D that are electrically connected in series. As one example, FIG. 4 illustrates a mode in which five diodes D1 to D5 are electrically connected in series. With the temperature detection element 11 as described above, when a constant current flows, sensitivity of the temperature detection element 11 with respect to a temperature of a forward voltage can be set to approximately −10 mV/° C. The first wiring line La extending from the first terminal 102*a* is electrically connected to an anode 11*a* of the temperature detection element 11. The second wiring line Lc extending from the second terminal 102*c* is electrically connected to a cathode 11*c* of the temperature detection element 11. Therefore, in the present mode, the first wiring line La is an anode wiring line, and the second wiring line Lc is a cathode wiring line. The first terminal 102*a* is an anode terminal, and the second terminal 102*c* is a cathode terminal. A ground potential GND is supplied to the second wiring line Lc.

In the electro-static protection circuit 12, the transistor Tr is an N-channel type thin film transistor having an LDD structure, and includes a semiconductor layer containing polysilicon as an active layer, similarly to the pixel transistor 30. The channel width of the transistor Tr is, for example, 800 μm, and the channel length thereof is, for example, 5 μm. One source-drain of the transistor Tr is electrically connected to the first wiring line La between the first terminal 102*a* and the anode 11*a* of the temperature detection element 11. The electro-static protection circuit 12 includes a first resistor element R1 between a coupling point Pa of the transistor Tr and the first terminal 102*a* in the first wiring line La. For example, the resistance value of the first resistor element R1 is 10 kΩ.

The other source-drain region of the transistor Tr is electrically connected to the second wiring line Lc between the second terminal 102*c* and the cathode 11*c* of the temperature detection element 11. The electro-static protection circuit 12 includes a second resistor element R2 between a coupling point Pc of the transistor Tr and the second terminal 102*c* in the second wiring line Lc. For example, the resistance value of the second resistor element R2 is 10 kΩ.

In the electro-static protection circuit 12, a first capacitance element C1 and a second capacitance element C2 that are electrically connected in series are electrically connected to each other between the first wiring line La and the second wiring line Lc. More specifically, one electrode of the first capacitance element C1 is electrically connected to the first wiring line La, one electrode of the second capacitance element C2 is electrically connected to the second wiring line Lc, the other electrode of the first capacitance element C1 and the other electrode of the second capacitance element C2 are electrically connected to each other. Therefore, the first capacitance element C1 and the second capacitance element C2 are electrically connected in series between the first wiring line La and the second wiring line Lc. The one electrode of the first capacitance element C1 is electrically connected to the first wiring line La between the coupling point Pa of the transistor Tr and the first resistor element R1, and the one electrode of the second capacitance element C2 is electrically connected to the second wiring line Lc between the coupling point Pc of the transistor Tr and the second resistor element R2.

A coupling node Cn between the first capacitance element C1 and the second capacitance element C2 is electrically connected to a gate of the transistor Tr. The electro-static protection circuit 12 includes a third resistor element R3 that is electrically connected to the second capacitance element C2 in parallel. More specifically, a gate wiring ling Lg extending from a gate of the transistor Tr is electrically connected to the coupling node Cn between the first capacitance element C1 and the second capacitance element C2, and further electrically connected to the second wiring line Lc via the third resistor element R3. For example, the resistance value of the third resistor element R3 is 500 kΩ.

The diodes D and the like forming the temperature detection element 11 are formed through use of the step of forming the elements forming the pixels 100*a* and the drive circuit at the first substrate 10. For example, through use of the step of forming the pixel transistor 30 and a driving circuit transistor of the scanning line drive circuit 104, the diodes D may be formed. After the semiconductor layer of the pixel transistor 30 is formed, the first resistor element R1, the second resistor element R2, and the third resistor element R3 may be formed through use of the step of introducing impurities into the semiconductor layer. Through use of the step of forming a metal layer, a metal compound layer, or a polysilicon layer that forms the gate electrode of the pixel transistor 30, the scanning line 3*a*, and the like, the first resistor element R1, the second resistor element R2, and the third resistor element R3 may be formed. Through use of the step of forming the retention capacitor 55, the first capacitance element C1 and the second capacitance element C2 may be formed.

When the electro-optical device 100 thus configured is mounted to an electronic apparatus and is driven, the temperature detection drive circuit 66 of the upper circuit 60 supplies a driving current IF being a constant current to the temperature detection element 11 via the wiring substrate 70, and also detects an output voltage VF of the temperature detection element 11 when the driving current IF is supplied. The temperature detection drive circuit 66 includes a constant current circuit 661 and a third capacitance element C3 as a stabilizing capacitor between the constant current circuit 661 and the ground potential GND. The third capacitance element C3 has one electrode electrically connected to a wiring line 666 and the other electrode electrically connected to a wiring line 667. The wiring line 666 is electrically connected to the first terminal 102*a*, the wiring line 667 is electrically connected to the second terminal 102*c* and the ground potential GND. The third capacitance element C3 stabilizes a measurement value of the voltage VF. An electro-static capacitance of the third capacitance element C3 is 0.1 μF, for example. Note that, unless otherwise described, description is given assuming that the output voltage of the temperature detection circuit 1 indicates the voltage VF being a forward voltage of the temperature detection element 11.

Here, the voltage VF being a forward voltage of the temperature detection element 11 including the diodes D has linear characteristics with respect to a temperature. The temperature detection drive circuit 66 supplies, to the temperature detection element 11, the forward driving current IF having a minute value of approximately 100 nA to a several μA, and detects a voltage between the first terminal 102*a* and the second terminal 102*c* (the output voltage VF of the temperature detection circuit 1) at this state. With this, the upper circuit 60 is capable of detecting a temperature of the display region 10*a* of the electro-optical panel 100*p*. More specifically, the output voltage VF of the temperature detection circuit 1 has satisfactory linear characteristics with respect to a temperature within a specified temperature range at the time of using the electro-optical device 100 as a light valve or the like of a projection-type display apparatus described later. Thus, when calibration is performed in advance, a temperature of the electro-optical panel 100*p* can be detected. Thus, when temperature control of the electro-optical panel 100*p*, correction of the image signal VID, or the like is performed based on temperature detection performed by the temperature detection circuit 1, the electro-optical device 100 can be driven under an appropriate condition suitable for a temperature of the display region 10*a*. Thus, an image with high quality can be displayed.

Note that the gate electrode of the transistor Tr is electrically connected to the second wiring line Lc via the third resistor element R3, and hence the gate electrode and the second wiring line Lc have an equal potential. Therefore, the transistor Tr is in an off state, and hence a constant current IF supplied to the first wiring line La does not flow to the transistor Tr, and flows to the temperature detection element 11 when the temperature detection element 11 detects a temperature.

Further, when a surge current caused by static electricity enters from the first terminal 102*a*, the electro-static protection circuit 12 protects the temperature detection element 11 from static electricity. More specifically, in the electro-static protection circuit 12, the gate-source voltage of the transistor Tr is 0 V in a static state, and the transistor Tr is in an off state. Here, when a surge current caused by static electricity enters from the first terminal 102*a*, the potential of the gate electrode of the transistor Tr, which is the potential of the coupling node Cn between the first capacitance element C1 and the second capacitance element C2, is increased while the first resistor element R1 suppresses voltage fluctuations. Thus, the transistor Tr is in an on state, and hence a surge current flows to the second terminal 102*c* via the transistor Tr and the second wiring line Lc. At this state, the first resistor element R1 reduces a surge current entering from the first terminal 102*a*, and the second resistor element R2 reduces a surge current entering from the second terminal 102*c*. A period during which the transistor Tr is in an on state is determined by the gate capacitances or the like of the first capacitance element C1, the second capacitance element C2, the third resistor element R3, and the transistor Tr. After discharging, the third resistor element R3 restores the gate-source voltage of the transistor Tr to 0 V. Thus, a surge current flowing to the temperature detection element 11 is suppressed by the electro-static protection circuit 12. Thus, the temperature detection element 11 can be protected. Note that the first resistor element R1 and the second resistor element R2 causes voltage drop due to the driving current IF of the temperature detection element 11. However, the driving current IF is extremely small, and hence the voltage drop at the first resistor element R1 and the second resistor element R2 is negligible.

1-4. Terminals 102 and Insulation Inspection

Figure 5:
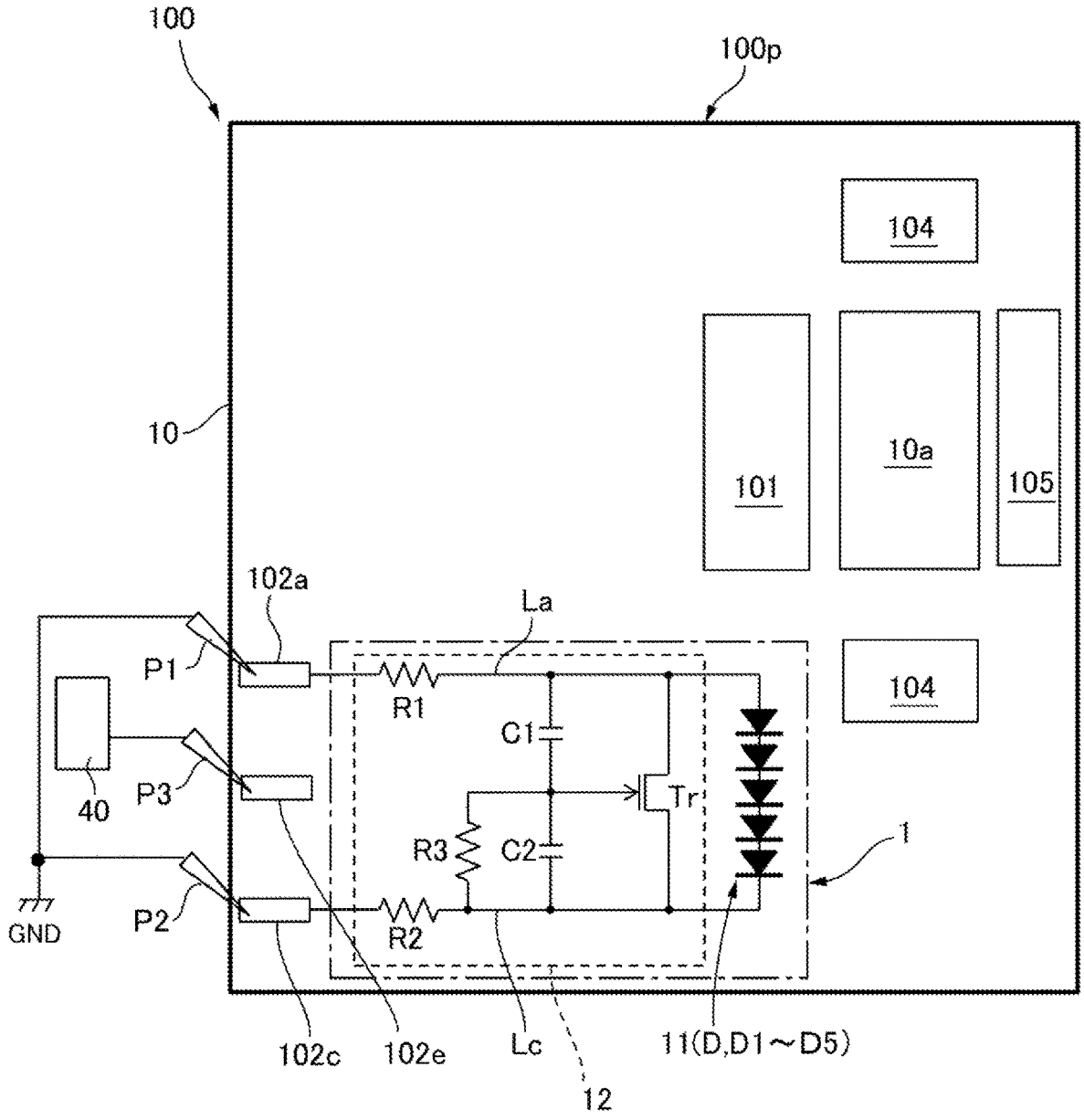
FIG. 5 is an explanatory diagram schematically illustrating terminals and the like illustrated in FIG. 4.

FIG. 5 is an explanatory diagram schematically illustrating the terminals 102 and the like illustrated in FIG. 4. As illustrated in FIG. 5, in the present exemplary embodiment, an inspection device 4 inspects insulation between the first terminal 102*a* and the second terminal 102*c* in a state of the first substrate 10 illustrated in FIG. 3 before the wiring substrate 70 is mounted, or a state of the electro-optical panel 100*p* before mounting the wiring substrate 70. The inspection device 4 applies a voltage to a predetermined terminal 102 via a probe, and detects a current at this state. Uppermost layers of all the terminals 102 including the first terminal 102*a* and the second terminal 102*c* are formed of light-transmissive conductive films such as ITO films, for example.

The inspection device 4 includes a power source device 40 including a voltage application means and a current detection means, a first probe P1, a second probe P2, and a third probe P3. Further, the plurality of terminals 102 of the first substrate 10 includes a third terminal 102*e* that is not electrically connected to the temperature detection element 11, between the first terminal 102*a* and the second terminal 102*c*. Therefore, the first probe P1 of the inspection device 4 abuts against the first terminal 102*a*, and the second probe P2 abuts against the second terminal 102*c*. With this, the ground potential GND is applied to the first terminal 102*a* and the second terminal 102*c*. Further, the third probe P3 abuts against the third terminal 102*e*, and a predetermined voltage is applied to the third terminal 102*e*. Then, a current of the third probe P3 is detected by the inspection device 4. In this case, the inspection device 4 applies a relatively high voltage to the third terminal 102*e*. In this case, the first terminal 102*a* and the second terminal 102*c* have an equal potential. Thus, a voltage is not applied to the diodes D of the temperature detection circuit 1 or the transistor Tr. Therefore, a current flowing through the diodes D and the transistor Tr is zero. Further, breakage does not occur to the diodes D and the transistor Tr.

As a result obtained by the inspection, when the inspection device 4 detects almost no current at the third probe P3, the third terminal 102*e* and the first terminal 102*a* are in a sufficient insulation state, and the third terminal 102*e* and the second terminal 102*c* are also in a sufficient insulation state. The first terminal 102*a*, the third terminal 102*e*, and the second terminal 102*c* are arranged adjacent to each other. Hence, it is hardly conceivable that residues of the conductive film forming each of the terminals cause short-circuit between the first terminal 102*a* and the second terminal 102*c*, for example. Therefore, it can be determined that sufficient insulation is secured between the first terminal 102*a* and the second terminal 102*c*.

In contrast, when the inspection device 4 detects a current of a predetermined level or higher at the third probe P3, the third terminal 102*e* and the first terminal 102*a* are short-circuited or connected to each other with high resistance, or the third terminal 102*e* and the second terminal 102*c* are short-circuited or connected to each other with high resistance. The first terminal 102*a*, the third terminal 102*e*, and the second terminal 102*c* are arranged adjacent to each other. Hence, it is strongly estimated that residues of the conductive film forming each of the terminals cause short-circuit between the first terminal 102*a* and the second terminal 102*c*, for example. Therefore, it can be determined that sufficient insulation is not secured between the first terminal 102*a* and the second terminal 102*c*.

For example, in a case of the electro-optical device 100 of a transmission-type, the uppermost layer of the terminal 102 is formed of ITO being the same layer as the pixel electrode 9*a* in most cases. An ITO film is a light-transmissive conductive film, and hence it is difficult to optically confirm residues that cause short-circuit between the terminals 102. However, with the present configuration, inspection is electrically facilitated. Therefore, an inspection result shows any irregularities, feedback can be made quickly to a manufacturing step or the like.

The first terminal 102*a* and the second terminal 102*c* have an equal potential. Thus, a voltage is not applied to the diodes D of the temperature detection circuit 1 or the transistor Tr. Therefore, inspection can be performed by applying a relatively high voltage from the third probe P3 to the third terminal 102*e* without causing damage at the circuit element of the temperature detection circuit 1. Thus, for example, even when the third terminal 102*e* and the first terminal 102*a* are connected to each other with high resistance, a detection current value of the third probe P3 can be increased, and hence inspection can be performed with high sensitivity.

As described above, in the present exemplary embodiment, inspection is performed through use of the third terminal 102*e* that is not electrically connected to the temperature detection element 11. Thus, during the inspection, an influence of a current flowing through the temperature detection element 11 and the transistor Tr can be eliminated. Therefore, insulation between the first terminal 102*a* and the second terminal 102*c* can be inspected easily and securely.

Note that, after the electro-optical device 100 is mounted to an electronic apparatus, the third terminal 102*e* is regarded as a dummy terminal, and is not used for an operation of the electro-optical device 100 or the like. Therefore, a terminal distance between the first terminal 102*a* and the second terminal 102*c* is substantially increased, which can suppress short-circuit between the first terminal 102*a* and the second terminal 102*c* at the time of mounting the wiring substrate 70. Such short-circuit may occur due to misalignment of the wiring substrate 70 with respect to the terminal 102.

2. SECOND EXEMPLARY EMBODIMENT

Figure 6:
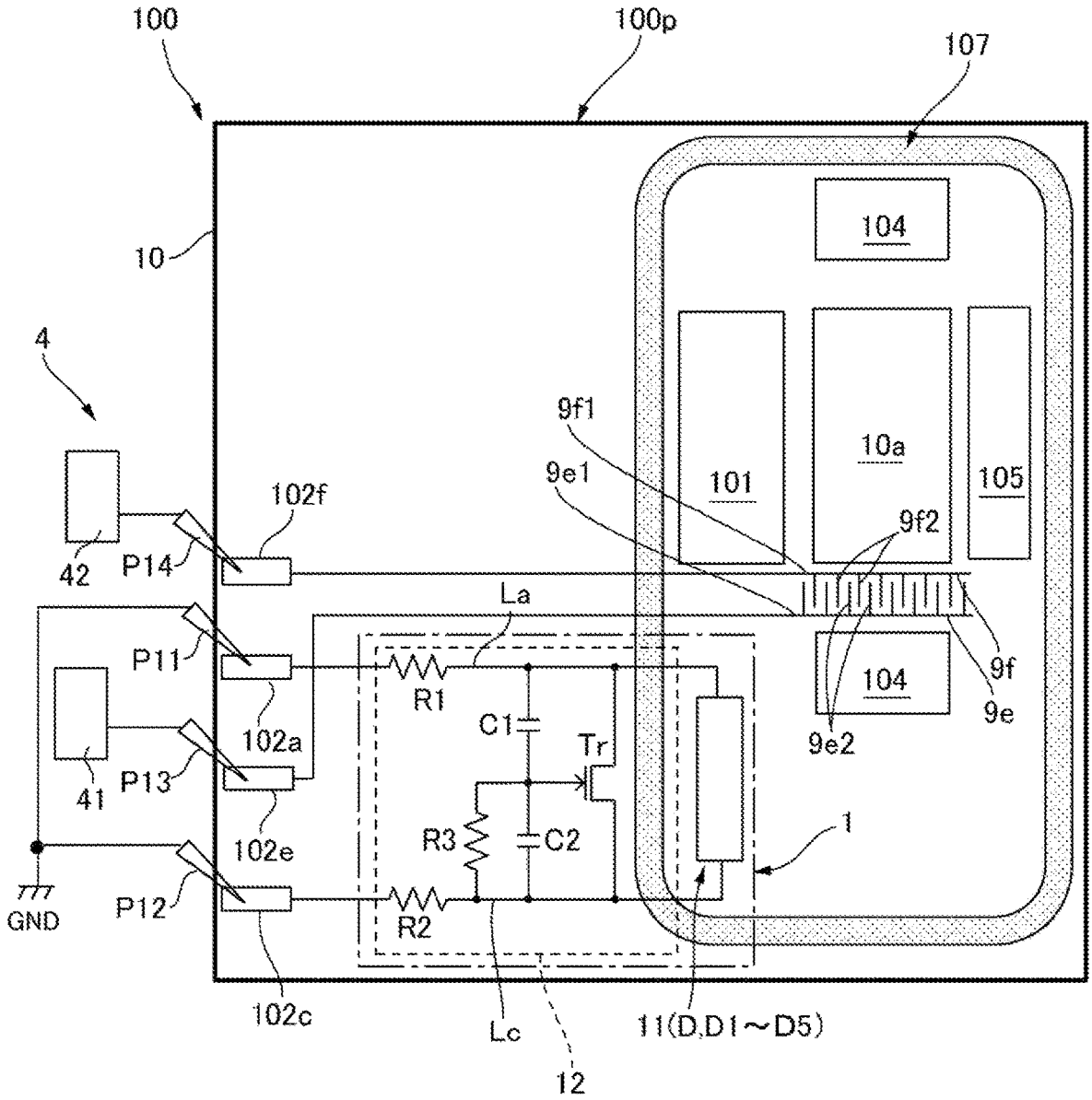
FIG. 6 is an explanatory diagram of an electro-optical device according to a second exemplary embodiment of the present disclosure.

FIG. 6 is an explanatory diagram of the electro-optical device 100 according to a second exemplary embodiment of the present disclosure. The terminals 102 and the like are schematically illustrated in FIG. 6. Note that, basic configurations in this exemplary embodiment are similar to those in the first exemplary embodiment. Thus, common portions are denoted with the identical reference symbols, and description therefor is omitted.

As illustrated in FIG. 6, the first substrate 10 is provided with the third terminal 102*e* that is not electrically connected to the temperature detection element 11, between the first terminal 102*a* and the second terminal 102*c*. Further, a fourth terminal 102*f* is provided to sandwich the first terminal 102*a* or the second terminal 102*c* with use of the third terminal 102*e*. In the present exemplary embodiment, the fourth terminal 102*f* is provided to sandwich the first terminal 102*a* with use of the third terminal 102*e*. Here, the fourth terminal 102*f* is not electrically connected to the temperature detection element 11. Further, the fourth terminal 102*f* is not electrically connected to any one of the first terminal 102*a*, the second terminal 102*c*, and the third terminal 102*e*.

In the present exemplary embodiment, the inspection device 4 includes a first power source device 41 including a voltage application means and a current detection means, a second power source device 42 including a voltage application means and a current detection means, a first probe P11, a second probe P12, a third probe P13, and a fourth probe P14. Therefore, similarly to the first exemplary embodiment, the first probe P11 of the inspection device 4 abuts against the first terminal 102*a*, and the second probe P12 abuts against the second terminal 102*c*. With this, the ground potential GND is applied to the first terminal 102*a* and the second terminal 102*c*. Further, the third probe P13 abuts against the third terminal 102*e*, and the first power source device 41 applies a predetermined voltage to the third terminal 102*e*. Then, a current of the third probe P13 at this state is detected by the first power source device 41. In the present exemplary embodiment, the inspection device 4 applies a relatively high voltage. Further, the fourth probe P14 of the inspection device 4 abuts against the fourth terminal 102*f*, and the second power source device 42 applies a predetermined voltage to the fourth terminal 102*f*. Then, a current of the fourth probe P14 at this state is detected by the second power source device 42.

As a result, when the first power source device 41 detects almost no current at the third probe P13, the third terminal 102*e* and the first terminal 102*a* are in a sufficient insulation state, and the third terminal 102*e* and the second terminal 102*c* are also in a sufficient insulation state. The first terminal 102*a*, the third terminal 102*e*, and the second terminal 102*c* are arranged adjacent to each other. Hence, it is hardly conceivable that residues of the conductive film forming each of the terminals cause short-circuit between the first terminal 102*a* and the second terminal 102*c*, for example. Therefore, it can be determined that sufficient insulation is secured between the first terminal 102*a* and the second terminal 102*c*.

In contrast, when the first power source device 41 detects a current of a predetermined level or higher at the third probe P13, the third terminal 102*e* and the first terminal 102*a* are short-circuited or connected to each other with high resistance, or the third terminal 102*e* and the second terminal 102*c* are short-circuited or connected to each other with high resistance. The first terminal 102*a*, the third terminal 102*e*, and the second terminal 102*c* are arranged adjacent to each other. Hence, it is strongly estimated that residues of the conductive film forming each of the terminals cause short-circuit between the first terminal 102*a* and the second terminal 102*c*, for example. Therefore, it can be determined that sufficient insulation is not secured between the first terminal 102*a* and the second terminal 102*c*.

Further, the second power source device 42 detects almost no current at the fourth probe P14, the fourth terminal 102*f* and the first terminal 102*a* are in a sufficient insulation state. Therefore, it can be determined that sufficient insulation is secured between the first terminal 102*a* and the terminal 102 arranged on a side of the first terminal 102*a*, which is opposite to the second terminal 102*c* side.

In contrast, when the second power source device 42 detects a current of a predetermined level of higher at the fourth probe P14, the fourth terminal 102*f* and the first terminal 102*a* are short-circuited or connected to each other with high resistance. Therefore, it can be determined that sufficient insulation is not secured between the first terminal 102*a* and the terminal 102 arranged on a side of the first terminal 102*a*, which is opposite to the second terminal 102*c* side.

In the present exemplary embodiment, the first terminal 102*a* and the second terminal 102*c* also have an equal potential. Thus, a voltage is not applied to the diodes D of the temperature detection circuit 1 or the transistor Tr. Therefore, inspection can be performed by applying a relatively high voltage from the third probe P13 to the third terminal 102*e* without causing damage at the circuit element of the temperature detection circuit 1. Further, inspection can be performed by applying a relatively high voltage from the fourth probe P14 to the third terminal 102*e*. Therefore, a detection current value can be increased, and hence inspection can be performed with high sensitivity.

Here, there can be adopted a configuration in which the third terminal 102*e* and the fourth terminal 102*f* are regarded as dummy terminals, and are not used for an operation of the electro-optical device 100 or the like after the electro-optical device 100 is mounted to an electronic apparatus.

As described below, in the present exemplary embodiment, after the electro-optical device 100 is mounted to an electronic apparatus, the third terminal 102*e* and the fourth terminal 102*f* are used so as to improve reliability of display of the electro-optical device 100. More specifically, the first substrate 10 is provided with a first electrode 9*e* electrically connected to the third terminal 102*e*, and the first electrode 9*e* is arranged along the display region 10*a*. Further, the first substrate 10 is provided with a second electrode 9*f* electrically connected to the fourth terminal 102*f*, and the second electrode 9*f* is arranged along the display region 10*a*.

The first electrode 9*e* includes a first extension portion 9*e*1 and first protruding portions 9*e*2 protruding from the first extension portion 9*e*1. The second electrode 9*f* includes a second extension portion 9*f*1 and second protruding portions 9*f*2 protruding from the second extension portion 9*f*1. The first extension portion 9*e*1 of the first electrode 9*e* and the second extension portion 9*f*1 of the second electrode 9*f* are arranged along the display region 10*a*. The first protruding portions 9*e*2 protrude to a side of the second extension portion 9*f*1 of the second electrode 9*f*, and the second protruding portions 9*f*2 protrude to a side of the first extension portion 9*e*1 of the first electrode 9*e*. Thus, the first protruding portions 9*e*2 of the first electrode 9*e* and the second protruding portions 9*f*2 of the second electrode 9*f* are arranged alternately in a comb-like shape. Note that, in FIG. 6, the first electrode 9*e* and the second electrode 9*f* are illustrated partially and abstractly.

In the electro-optical device 100 according to the present exemplary embodiment, for example, the first electrode 9*e* and the second electrode 9*f* are arranged in the same layer as the pixel electrode 9*a* in the region surrounded by the seal material 107 illustrated in FIG. 1, and different potentials are applied to the first electrode 9*e* and the second electrode 9*f*, respectively. Therefore, in the electro-optical layer 50 illustrated in FIG. 2, movable ions generated along with degradation of a liquid crystal layer forming the electro-optical layer 50 are discharged to the outside of the display region 10*a* and stagnate, due to an electric field action the first electrode 9*e* and the second electrode 9*f*. Thus, in the electro-optical device 100, degradation of image quality, such as burning caused by movable ions is less likely to occur.

Here, in the present exemplary embodiment, the third terminal 102*e* is electrically connected to the first electrode 9*e*, and is not electrically connected to the circuit elements such as the transistor and the capacitance element formed at the first substrate 10. Similarly, the fourth terminal 102*f* is electrically connected to the second electrode 9*f*, and is not electrically connected to the circuit elements such as the transistor and the capacitance element formed at the first substrate 10. With this configuration, even when a relatively high voltage is applied to the third terminal 102*e*, inspection can be performed while eliminating a current due to short-circuit occurring at a point other than the vicinity of the third terminal 102*e*. For example, when the third terminal 102*e* is electrically connected to the circuit elements such as the transistor and the capacitance element formed at the first substrate 10, there may be a possibility that a current generated as a result of breakage of those circuit elements is detected at the time of applying a voltage. Similarly, when the fourth terminal 102*f* is electrically connected to the circuit elements such as the transistor and the capacitance element formed at the first substrate 10, there may be a possibility that a current generated as a result of breakage of those circuit elements is detected at the time of applying a voltage.

In view of this, as in the present exemplary embodiment, there is adopted a configuration in which the third terminal 102*e* and the fourth terminal 102*f* are not electrically connected to the circuit elements such as the transistor and the capacitance element formed at the first substrate 10. With this, insulation between the first terminal 102*a* and the second terminal 102*c* can be inspected securely and easily. Further, the third terminal 102*e* and the fourth terminal 102*f* are not merely inspection terminals, but are utilized as effective terminals. Therefore, the total number of terminals 102 of the electro-optical device 100 can be reduced, and the electro-optical device 100 is not increased in size.

2-1. First Modification Example in Second Exemplary Embodiment

In the second exemplary embodiment, the first electrode 9*e* and the second electrode 9*f* eliminates movable ions from the display region 10*a*. The first electrode 9*e* and the second electrode 9*f* may be used to detect specific resistance of the liquid crystal layer forming the electro-optical layer 50, thereby monitoring degradation of the liquid crystal layer.

2-2. Second Modification Example in Second Exemplary Embodiment

In the second exemplary embodiment, the first electrode 9*e* and the second electrode 9*f* are provided, but only one of the first electrode 9*e* and the second electrode 9*f* may be provided. In this case, with respect to the first electrode 9*e* extending from the third terminal 102*e* or the second electrode 9*f* extending from the fourth terminal 102*f*, a potential different from the common potential LCCOM applied to the common electrode 21 of the second substrate 20 illustrated in FIG. 2 may be applied to the first electrode 9*e*, and movable ions may be eliminated from the display region 10*a*. Further, the first electrode 9*e* extending from the third terminal 102*e* or the second electrode 9*f* extending from the fourth terminal 102*f*, and the common electrode 21 of the second substrate 20 may be used to detect specific resistance of the liquid crystal layer forming the electro-optical layer 50, thereby monitoring degradation of the liquid crystal layer.

2-3. Third Modification Example in Second Exemplary Embodiment

In the second exemplary embodiment, the first electrode 9*e* and the second electrode 9*f* are provided. However, at least one of the first electrode 9*e* and the second electrode 9*f* may be provided, and the first electrode 9*e* extending from the third terminal 102*e* or the second electrode 9*f* extending from the fourth terminal 102*f* may be electrically connected to the dummy pixel electrode 9*b*. With this, the common potential LCCOM may be applied to the dummy pixel electrode 9*b*. With this configuration, a voltage is not applied to the electro-optical layer 50 in the periphery of the display region 10*a*. Thus, degradation of a liquid crystal layer forming the electro-optical layer 50 can be suppressed. In this case, with respect to the first electrode 9*e* extending from the third terminal 102*e* or the second electrode 9*f* extending from the fourth terminal 102*f*, the first electrode 9*e* extending from the third terminal 102*e* or the second electrode 9*f* extending from the fourth terminal 102*f* may be electrically connected to the dummy pixel electrode 9*b* at a position overlapping with the seal material 107 or on the outer side of the seal material 107.

2-4. Fourth Modification Example in Second Exemplary Embodiment

The configuration is not limited to that in the second exemplary embodiment as long as the first electrode 9*e* is provided and the second electrode 9*f* is not provided. The first electrode 9*e* may extend the third terminal 102*e* provided in the first exemplary embodiment.

In the second exemplary embodiment and each of the modification examples, the first electrode 9*e* and the second electrode 9*f* may be arranged by using, for example, a low resistance wiring line containing aluminum as appropriate. Further, the first electrode 9*e* and the second electrode 9*f* are not necessarily arranged at the pixel electrode layer. For example, the first electrode 9*e* and the second electrode 9*f* may be arranged at the same layer as the wiring line at the lower layer with respect to the pixel electrode. Further, at the first electrode 9*e* and the second electrode 9*f*, resistor elements may be arranged at a wiring line electrically connected to the third terminal 102*e* and the fourth terminal 102*f*. For example, the resistor element may be formed through use of the semiconductor layer forming the pixel transistor 30 formed at the first substrate 10, the conductive layer forming the gate electrode, and the conductive layer forming the source-drain electrode. Moreover, the first electrode 9*e* and the second electrode 9*f* may be electrically connected to other terminals 102, thereby forming heating lines. Such a heating line may be formed of the resistor element described above. Such a heating line is one mode of a configuration for adjusting a temperature of the electro-optical panel 100*p*.

3. THIRD EXEMPLARY EMBODIMENT

Figure 7:
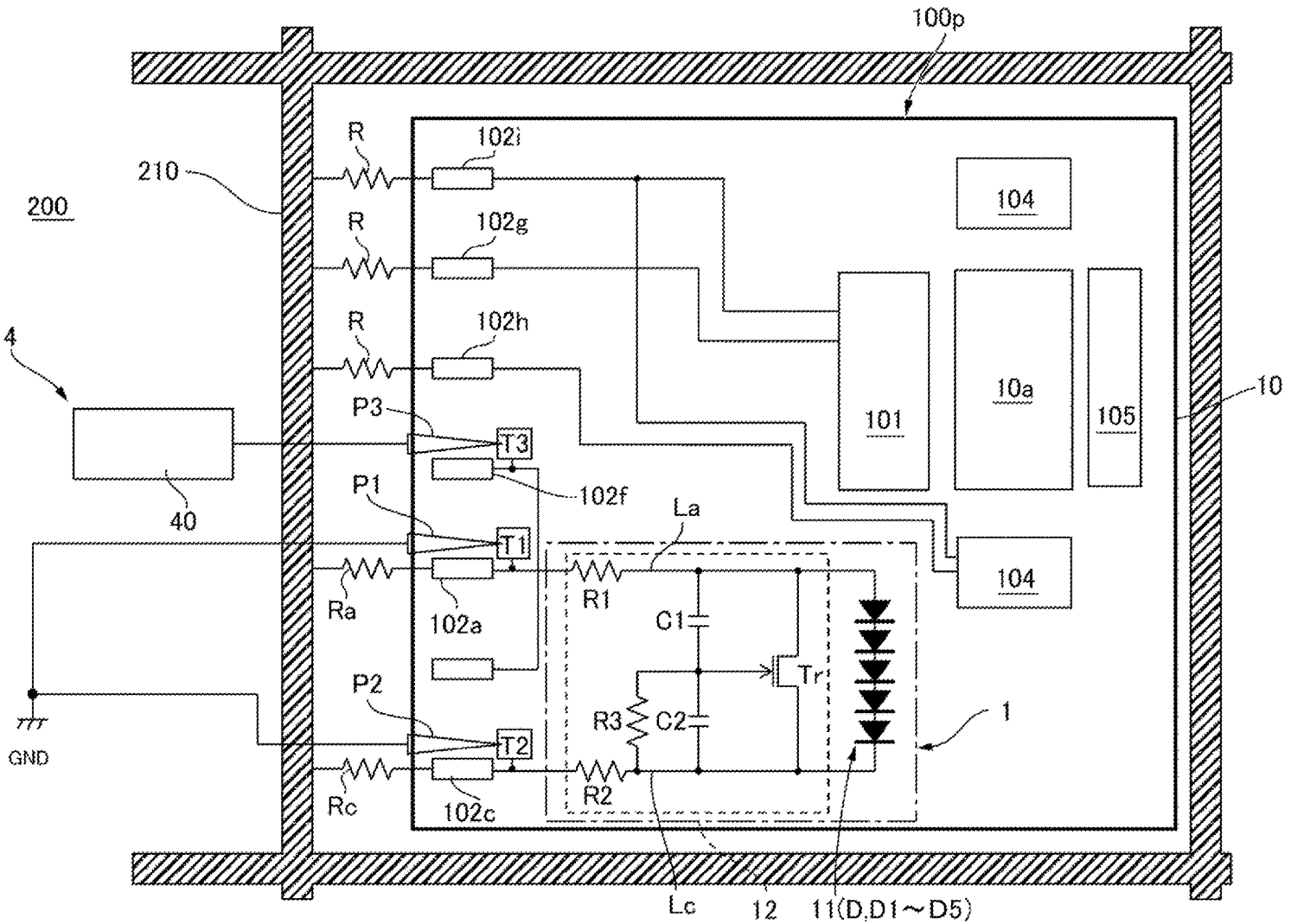
FIG. 7 is an explanatory diagram of an electro-optical device according to a third exemplary embodiment of the present disclosure.

FIG. 7 is an explanatory diagram of the electro-optical device 100 according to a third exemplary embodiment of the present disclosure. The terminals 102 and the like are schematically illustrated in FIG. 7. Note that, basic configurations in this exemplary embodiment are similar to those in the first exemplary embodiment. Thus, common portions are denoted with the identical reference symbols, and description therefor is omitted.

As illustrated in FIG. 7, the first substrate 10 is provided with the third terminal 102*e* that is not electrically connected to the temperature detection element 11, between the first terminal 102*a* and the second terminal 102*c*. Further, the fourth terminal 102*f* is provided to sandwich the first terminal 102*a* with use of the third terminal 102*e*. Here, the fourth terminal 102*f* is electrically connected to the third terminal 102*e*. In other words, there is achieved a configuration in which, when the probe abuts against any one of the third terminal 102*e* and the fourth terminal 102*f*, an equal potential can be applied to the third terminal 102*e* and the fourth terminal 102*f*.

Therefore, the first probe P1 of the inspection device 4 abuts against the first terminal 102*a*, and the second probe P2 abuts against the second terminal 102*c*. With this, the ground potential GND is applied to the first terminal 102*a* and the second terminal 102*c*. Further, the third probe P3 abuts against the third terminal 102*e* or the fourth terminal 102*f*, and the power source device 40 including the voltage application means and the current detection means applies a predetermined voltage to the third terminal 102*e* and the fourth terminal 102*f*. Then, a current of the third probe P3 at this state is detected.

As a result, when the inspection device 4 detects almost no current at the third probe P3, the third terminal 102*e* and the first terminal 102*a* are in a sufficient insulation state, and the third terminal 102*e* and the second terminal 102*c* are also in a sufficient insulation state. Further, the fourth terminal 102*f* and the first terminal 102*a* are also in a sufficient insulation state. Therefore, it can be determined that the first terminal 102*a* and another adjacent terminal 102 are in a sufficient insulation state.

In contrast, when the inspection device 4 detects a current of a predetermined level or higher at the third probe P3, the first terminal 102*a*, and the third terminal 102*e* or the fourth terminal 102*f* short-circuited or connected to each other with high resistance. Alternatively, the third terminal 102*e* and the second terminal 102*c* are short-circuited or connected to each other with high resistance. Therefore, it can be determined that the possibility that sufficient insulation is not secured between the first terminal 102*a* and another adjacent terminal 102 is high.

Here, when the number of terminals 102 is large, and the area of the terminals 102 is small, it is difficult for the probe to abut against the terminal 102. In this case, in a region of the first substrate 10, which is separated away from the terminals 102, a first inspection terminal T1 electrically connected to the first terminal 102*a*, a second inspection terminal T2 electrically connected to the second terminal 102*c*, and a third inspection terminal T3 electrically connected to the third terminal 102*e* and the fourth terminal 102*f* are provided. Therefore, the first probe P1, and the second probe P2, and the third probe P3 abut against the first inspection terminal T1, the second inspection terminal T2, and the third inspection terminal T3, respectively. With this, inspection can be performed.

Further, when a large-size substrate 200 in which a plurality of first substrates 10 are arranged is manufactured, a short-circuit line 210 formed of a conductive film is provided in the periphery of the first substrate 10, and each of the terminals 102 is electrically connected to the short-circuit line 210 via a resistor element R in some cases. In this mode, each of the terminals 102 has an equal potential, and hence the circuit elements on the first substrate 10 can be protected from breakage due to static electricity or the like.

In this case, the first terminal 102*a* and the second terminal 102*c* are electrically connected to the short-circuit line 210 via resistor elements Ra and Rc, respectively. However, the third terminal 102*e* and the fourth terminal 102*f* are not electrically connected to the short-circuit line 210.

Further, a fifth terminal 102*g* of the terminals 102 is electrically connected to the short-circuit line 210 via the resistor element R. For example, the fifth terminal 102*g* is a terminal for various signals supplied to the data line drive circuit 101, and one fifth terminal 102*g* is representatively illustrated in FIG. 7. A sixth terminal 102*h* is electrically connected to the short-circuit line 210 via the resistor element R. For example, the sixth terminal 102*h* is a terminal for various signals supplied to the scanning line drive circuit 104, and one sixth terminal 102*h* is representatively illustrated in FIG. 7. A seventh terminal 102*i* is electrically connected to the short-circuit line 210 via the resistor element R. For example, the seventh terminal 102*i* is a terminal for various power sources supplied to the data line drive circuit 101 and the scanning line drive circuit 104, and one seventh terminal 102*i* is representatively illustrated in FIG. 7.

In the present exemplary embodiment, the first terminal 102*a* and the second terminal 102*c* are electrically connected to each other via the resistor elements Ra and Rc, and the short-circuit line 210. In other words, a current path is newly formed between the first terminal 102*a* and the second terminal 102*c*. Thus, when a voltage is applied between the first terminal 102*a* and the second terminal 102*c*, a short-circuit current is clearly observed. Thus, determination of insulation of the first terminal 102*a* is difficult. However, the third terminal 102*e* and the fourth terminal 102*f* are provided, and hence insulation of the first terminal 102*a* can be inspected similarly to the other exemplary embodiments.

Note that, after the large-size substrate 200 is divided into the plurality of first substrates 10, parts of the wiring lines used for electrical coupling with the short-circuit line 210 remain on the first substrate 10 from the terminals 102 other than the third terminal 102*e* and the fourth terminal 102*f* to the end of the first substrate 10.

4. FOURTH EXEMPLARY EMBODIMENT

Figure 8:
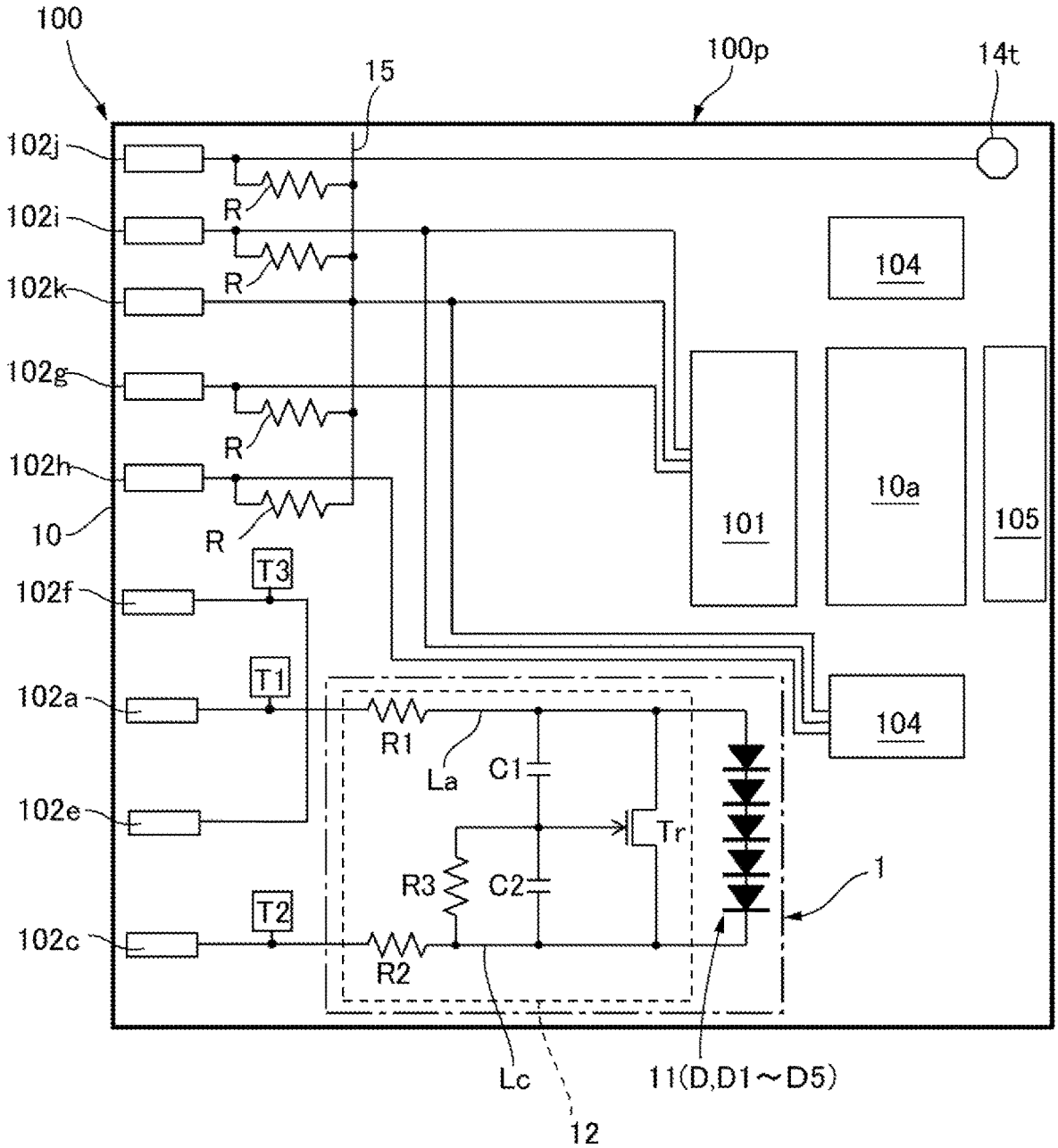
FIG. 8 is an explanatory diagram of an electro-optical device according to the fourth exemplary embodiment of the present disclosure.

FIG. 8 is an explanatory diagram of the electro-optical device 100 according to a fourth exemplary embodiment of the present disclosure. The terminals 102 and the like are schematically illustrated in FIG. 8. Note that, basic configurations in this exemplary embodiment are similar to those in the first exemplary embodiment. Thus, common portions are denoted with the identical reference symbols, and description therefor is omitted.

As illustrated in FIG. 8, the first substrate 10 is provided with the third terminal 102*e* that is not electrically connected to the temperature detection element 11, between the first terminal 102*a* and the second terminal 102*c*. The fourth terminal 102*f* is provided to sandwich the first terminal 102*a* with use of the third terminal 102*e*. Here, the fourth terminal 102*f* is electrically connected to the third terminal 102*e*.

Further, similarly to the third exemplary embodiment, in the present exemplary embodiment, the first inspection terminal T1 electrically connected to the first terminal 102*a*, the second inspection terminal T2 electrically connected to the second terminal 102*c*, and the third inspection terminal T3 electrically connected to the third terminal 102*e* and the fourth terminal 102*f* are provided.

Here, the first substrate 10 is provided with a short-circuit line 15, the terminals 102 other than the first terminal 102*a*, the second terminal 102*c*, the third terminal 102*e*, and the fourth terminal 102*f* are electrically connected to the short-circuit line 15 via the resistor element R. In other words, the first terminal 102*a*, the second terminal 102*c*, the third terminal 102*e*, and the fourth terminal 102*f* are not electrically connected to the short-circuit line 15.

The fifth terminal 102*g* is electrically connected to the short-circuit line 15 via the resistor element R. The fifth terminal 102*g* is a terminal for various signals supplied to the data line drive circuit 101, and one fifth terminal 102*g* is representatively illustrated in FIG. 8. The sixth terminal 102*h* is electrically connected to the short-circuit line 15 via the resistor element R. For example, the sixth terminal 102*h* is a terminal for various signals supplied to the scanning line drive circuit 104, and one sixth terminal 102*h* is representatively illustrated in FIG. 8. The seventh terminal 102*i* is electrically connected to the short-circuit line 15 via the resistor element R. For example, the seventh terminal 102*i* is a terminal for a power source at a high level, which is supplied to the data line drive circuit 101 and the scanning line drive circuit 104. An eighth terminal 102*j* is electrically connected to the short-circuit line 15 via the resistor element R. For example, the eighth terminal 102*j* is a terminal that supplies the common potential LCCOM to the inter-substrate conduction electrode portions 14*t* or the like. A ninth terminal 102*k* is electrically connected to the short-circuit line 15 without the resistor element R. For example, the ninth terminal 102*k* is a terminal for a power source at a low level, which is supplied to the data line drive circuit 101 and the scanning line drive circuit 104.

With this configuration, each of the terminals 102 also has an equal potential, and hence the circuit elements on the first substrate 10 can be protected from breakage due to static electricity or the like. The temperature detection circuit 1 is a small-size circuit, and is protected by the electro-static protection circuit 12. Further, the resistor element R remains in the electro-optical device 100, but the resistance value of the resistor element R is a several MΩ, which does not hinder an operation of the electro-optical device 100 driven by a voltage signal.

Further, according to the present exemplary embodiment, insulation of the first terminal 102*a* can be inspected by a method similar to that in the third exemplary embodiment.

5. ANOTHER EXEMPLARY EMBODIMENT OF ELECTRO-OPTICAL DEVICE

In the present disclosure, the electro-optical device 100 is not limited to a liquid crystal device. The present disclosure may be applied to the electro-optical device 100 other than a liquid crystal device, such as an organic electroluminescence device.

6. CONFIGURATION EXAMPLE OF ELECTRONIC APPARATUS

Figure 9:
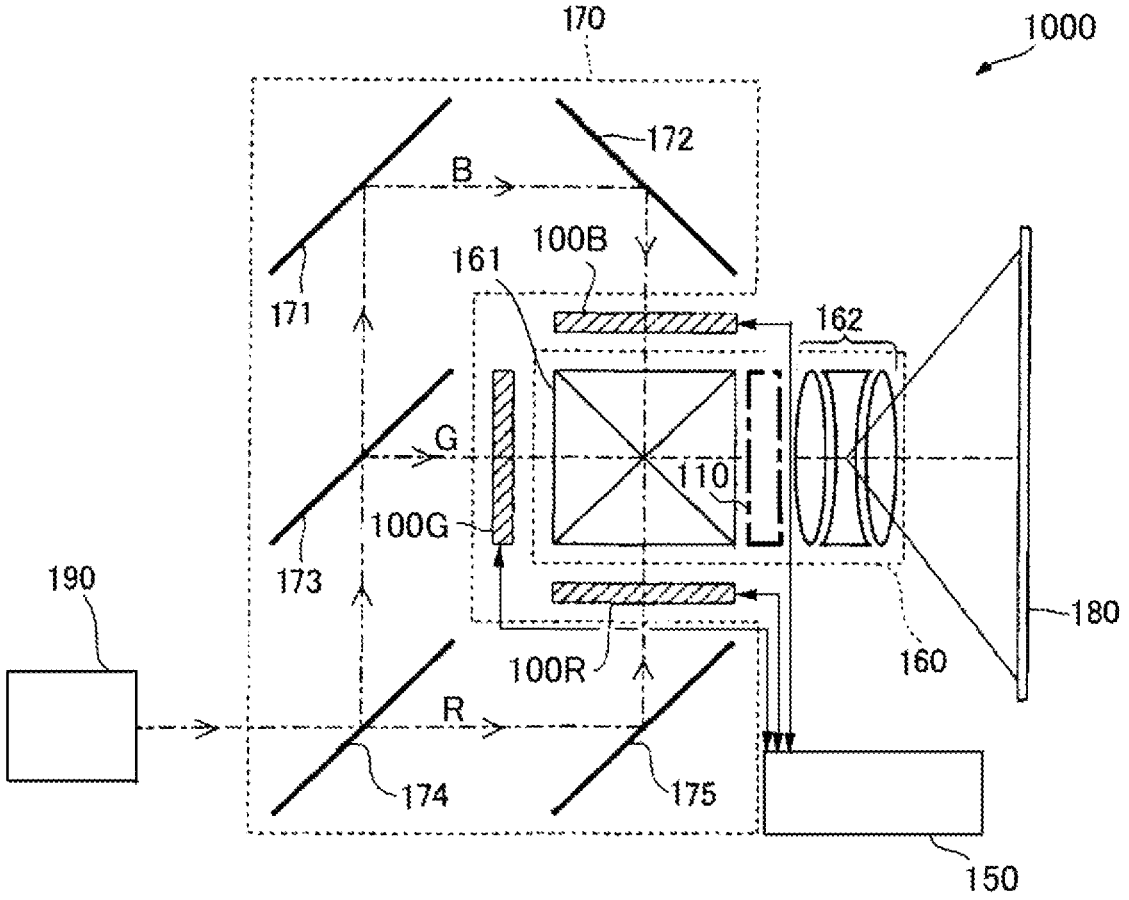
FIG. 9 is a block diagram illustrating a configuration example of a projection-type display apparatus to which the present disclosure is applied.
Figure 10:
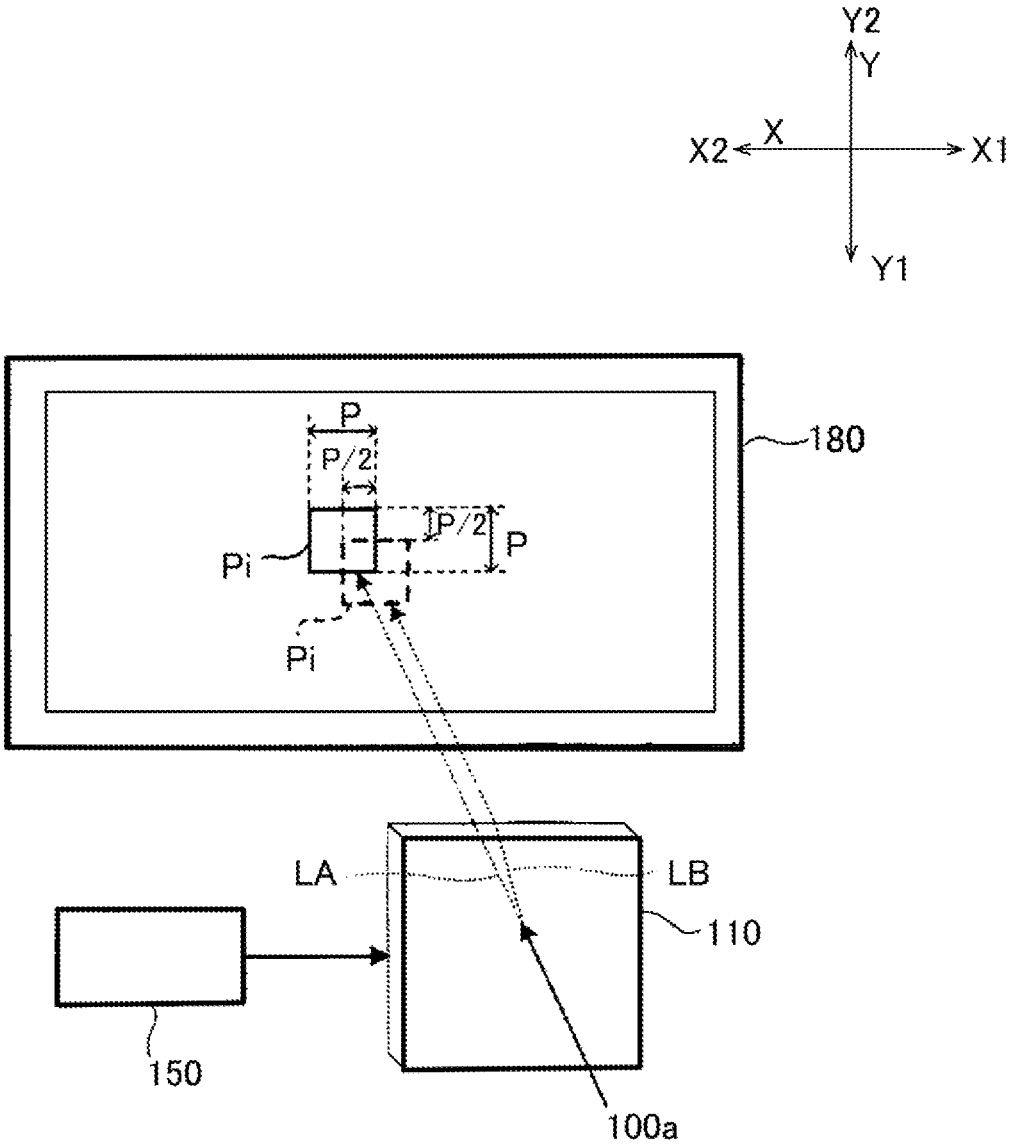
FIG. 10 is an explanatory diagram of an optical path shift element illustrated in FIG. 9.

FIG. 9 is a block diagram illustrating a configuration example of a projection-type display apparatus 1000 to which the present disclosure is applied. FIG. 10 is an explanatory diagram of an optical path shift element 110 illustrated in FIG. 9. Note that, in FIG. 9, the polarization plate and the like are omitted in illustration. The projection-type display apparatus 1000 illustrated in FIG. 9 is one example of an electronic apparatus to which the present disclosure is applied, and includes an illumination device 190, a separation optical system 170, three electro-optical devices 100R, 100G, and 100B, and a projection optical system 160. Each of the electro-optical devices 100R, 100G, and 100B is the electro-optical device 100 described with reference to FIG. 1 to FIG. 8.

The illumination device 190 is a white light source, and a laser light source or a halogen lamp is used, for example. The separation optical system 170 includes three mirrors 171, 172, and 175, and dichroic mirrors 173 and 174. The separation optical system 170 separates white light emitted from the illumination device 190 into the three primary colors including a red color R, a green color G, and a blue color B.

Specifically, the dichroic mirror 174 transmits light of the wavelength region of the red color R, and reflects light of the wavelength regions of the green color G and the blue color B. The dichroic mirror 173 transmits light of the wavelength region of the blue color B, and reflects light of the wavelength region of the green color G. The light of the red color R, the light of the green color G, and the light of the blue color B are guided by the electro-optical devices 100R, 100G, and 100B, respectively.

The light modulated by each of the electro-optical devices 100R, 100G, and 100B enters a dichroic prism 161 from three directions. The dichroic prism 161 forms a synthesis optical system in which an image of the red color R, an image of the green color G, and an image of the blue color B are synthesized. Therefore, a projection lens system 162 projects a synthesized image, which is emitted from the optical path shift element 110, onto a projected member such as a screen 180 in an enlarged manner, thereby displaying a color image on the projected member such as the screen 180.

In this case, a control unit 150 is capable of correcting an image signal to be supplied to the electro-optical devices 100R, 100G, and 100B, based on a temperature detection result obtained by the temperature detection circuit 1. Thus, even when an environment temperature or the like fluctuates, a projection image with high quality can be displayed. The optical path shift element 110 denoted with the one-dot chain line is provided to the projection optical system 160 on the side to which the dichroic prism 161 emits light, and a resolution is increased by a technique of shifting a position at which a projection pixel is visually recognized, every predetermined period. When such a configuration is adopted, it is required to drive a liquid crystal layer at a high speed. Even in this case, the electro-optical layer 50 including a liquid crystal layer can be driven at a high speed by adopting a configuration of correcting an image signal to be supplied to the electro-optical devices 100R, 100G, and 100B or adjusting a temperature of the electro-optical panel 100*p* of the electro-optical devices 100R, 100G, and 100B, based on the temperature detection result obtained by the temperature detection circuit 1.

As illustrated in FIG. 9, the optical path shift element 110 is an optical element that shifts light, which is emitted from the dichroic prism 161, in a predetermined direction. FIG. 10 illustrates a state in which a position of a projection pixel Pi, at which light emitted from each of the pixels 100*a* of the electro-optical panel 100*p* is visually recognized, is shifted by the optical path shift element 110 by a distance corresponding to 0.5 pixel pitch (=P/2) to one side X1 in the X direction and a 0.5 pixel pitch (=P/2) to one side Y1 in the Y direction. The optical path shift element 110 includes a light-transmissive plate, and an actuator swings the light-transmissive plate about one of the axial line extending in the first direction X and the axial line extending in the second direction Y, or about both the directions, under a command from the control unit 150. With this, an optical path of the light emitted from each of the pixels 100*a* of the electro-optical panel 100*p* can be shifted between an optical path LA and an optical path LB.

7. OTHER EXEMPLARY EMBODIMENTS OF ELECTRONIC APPARATUS

A projection-type display apparatus may be configured to use, as a light source unit, an LED light source configured to emit light in various colors, and the like to supply light in various colors emitted from the LED light source to another liquid crystal apparatus.

The electronic apparatus including the electro-optical device 100 to which the present disclosure is applied is not limited to the projection-type display apparatus 1000 of the above-described exemplary embodiment. Examples of the electronic apparatus may include a projection-type head up display (HUD), a direct-view-type head mounted display (HMD), a personal computer, a digital still camera, and a liquid crystal television.

What is claimed is:

1. An electro-optical device, comprising:

a temperature detection circuit including a temperature detection element;

a first terminal electrically connected to the temperature detection element;

a second terminal electrically connected to the temperature detection element; and a third terminal provided between the first terminal and the second terminal, and not electrically connected to the temperature detection element.

2. The electro-optical device according to claim 1, comprising a fourth terminal provided so as to sandwich the first terminal or the second terminal with the third terminal, and not electrically connected to the temperature detection element.

3. The electro-optical device according to claim 2, wherein the third terminal and the fourth terminal are not electrically connected to each other.

4. The electro-optical device according to claim 3, comprising:

a first electrode provided along a display region and electrically connected to the third terminal; and a second electrode provided along the display region and electrically connected to the fourth terminal.

5. The electro-optical device according to claim 4, wherein the first electrode includes a first protruding portion, the first protruding portion being provided along the second electrode and protruding toward the second electrode, and the second electrode includes a second protruding portion, the second protruding portion being provided along the first electrode and protruding toward the first electrode.

6. The electro-optical device according to claim 4, wherein different potentials are applied to the first electrode and the second electrode.

7. The electro-optical device according to claim 2, wherein the third terminal and the fourth terminal are electrically connected to each other.

8. The electro-optical device according to claim 1, comprising a first electrode provided along a display region and electrically connected to the third terminal.

9. The electro-optical device according to claim 1, comprising:

a first inspection terminal electrically connected to the first terminal;

a second inspection terminal electrically connected to the second terminal; and a third inspection terminal electrically connected to the third terminal.

10. The electro-optical device according to claim 1, comprising:

a data line drive circuit;

a scanning line drive circuit;

a fifth terminal electrically connected to the data line drive circuit;

a sixth terminal electrically connected to the scanning line drive circuit; and a short-circuit line electrically connected to the first terminal, the second terminal, the fifth terminal, and the sixth terminal, wherein the third terminal is not electrically connected to the short-circuit line.

11. The electro-optical device according to claim 10, wherein each of the first terminal, the second terminal, the fifth terminal, and the sixth terminal is electrically connected to the short-circuit line via a resistor element.

12. An electronic apparatus comprising the electro-optical device according to claim 1.

* * * * *